US007111881B2

(12) United States Patent
Paskonis

(10) Patent No.: US 7,111,881 B2
(45) Date of Patent: Sep. 26, 2006

(54) SINGLE-PIECE LATCH STRIKERS WITH MECHANICALLY LOCKED COMPONENTS

(75) Inventor: Almantas K. Paskonis, Concord, OH (US)

(73) Assignee: Tinnerman Palnut Engineered Products, Inc., Brunswick, OH (US)

( * ) Notice: Subject to any disclaimer, the term of this patent is extended or adjusted under 35 U.S.C. 154(b) by 0 days.

(21) Appl. No.: 11/091,178

(22) Filed: Mar. 28, 2005

(65) Prior Publication Data

US 2005/0167993 A1 Aug. 4, 2005

Related U.S. Application Data

(62) Division of application No. 10/324,972, filed on Dec. 19, 2002, now Pat. No. 6,883,842.

(51) Int. Cl.
*E05B 15/02* (2006.01)

(52) U.S. Cl. ..... 292/340; 292/DIG. 64

(58) Field of Classification Search ..... 292/340, 292/341, DIG. 64

See application file for complete search history.

(56) References Cited

U.S. PATENT DOCUMENTS

| | | | | |
|---|---|---|---|---|
| 477,654 | A | | 6/1892 | Grimes |
| 849,865 | A | | 4/1907 | Spencer |
| 1,690,408 | A | | 11/1928 | Hasenflue |
| 2,634,147 | A | | 4/1953 | Robertson |
| 2,661,973 | A | | 12/1953 | Sweger |
| 2,706,317 | A | | 4/1955 | Whittlesey |
| 2,775,799 | A | | 1/1957 | Friderich |
| 2,860,905 | A | | 11/1958 | Wise |
| 3,321,226 | A | | 5/1967 | De Claire |
| 4,045,064 | A | | 8/1977 | Okada |
| 4,220,364 | A | | 9/1980 | Poe |
| 4,438,963 | A | | 3/1984 | Friedrich |
| 4,447,080 | A | | 5/1984 | Hemmer |
| 4,691,952 | A | | 9/1987 | Harmon |
| 4,883,298 | A | | 11/1989 | Kleefeldt |
| 4,961,601 | A | | 10/1990 | Lindholm et al. |
| 5,125,698 | A | | 6/1992 | Than |
| 5,215,342 | A | | 6/1993 | Yuge et al. |
| 5,234,238 | A | | 8/1993 | Takimoto |
| 5,263,752 | A | * | 11/1993 | Phail-Fausey et al. ..... 292/340 |
| 5,342,103 | A | | 8/1994 | Tame et al. |
| 5,494,208 | A | * | 2/1996 | Granger ..... 228/173.6 |
| 5,501,495 | A | | 3/1996 | Claucherty |
| 5,707,092 | A | | 1/1998 | Van Slembrouck |
| 5,755,468 | A | | 5/1998 | Buchanan, Jr. |
| 5,833,024 | A | | 11/1998 | Kaneko |
| 6,000,737 | A | | 12/1999 | Yiu |
| 6,095,576 | A | | 8/2000 | Burton |

(Continued)

*Primary Examiner*—Gary Estremsky
(74) *Attorney, Agent, or Firm*—McDonald Hopkins Co., LPA; Robert H. Earp, III

(57) ABSTRACT

Mechanically locked strikers have a base, a striker bar, and a locking arm which extends from the base to the striker bar. In one embodiment the striker bar and locking arm are formed integrally with the base, with the striker bar extending from the base at one point or area, and the locking arm mechanically attached to the base at another point or area. Alternatively, the locking arm may extend from the base at one point or area, and the striker bar is mechanically attached to the base at another point or area. In another embodiment, the striker bar and locking arm are each mechanically locked to the base. A segment of the locking arm forms a bridge over the base, defining a throat for engagement of a latch about the striker bar.

16 Claims, 4 Drawing Sheets

U.S. PATENT DOCUMENTS 6,095,577 A * 8/2000 Nolzen ..... 292/340
6,106,037 A 8/2000 Burton
6,108,894 A 8/2000 Mizuki et al.
6,155,616 A 12/2000 Akright
D442,907 S 5/2001 Santelman
6,227,019 B1 5/2001 Chhatwal
6,273,480 B1 8/2001 Burton
6,616,204 B1 9/2003 Mitts et al.
6,692,046 B1 * 2/2004 Paskonis ..... 292/340
6,715,808 B1 4/2004 Oxley et al.
2003/0090114 A1 * 5/2003 Kang ..... 292/340

* cited by examiner

SINGLE-PIECE LATCH STRIKERS WITH MECHANICALLY LOCKED COMPONENTS

RELATED APPLICATION

This application is a divisional of U.S. patent application Ser. No. 10/324,972, filed Dec. 19, 2002 now U.S. Pat. No. 6,883,842.

FIELD OF THE INVENTION

The present invention is in the general area of latching and closing devices, and more particularly in the area of fixtures which engage with latches.

BACKGROUND OF THE INVENTION

Latch strikers serve as a structure for engagement with the catch or pawl of latch mechanism. In their simplest form a cylindrical rod or post is mounted in alignment with the latch or with the fishmouth of a latch assembly. Post or wire form strikers are widely used in automotive applications, such as shown for example in U.S. Pat. Nos. 4,911,488 and 4,998,759. As described in these and other patents, the cylindrical post or rod which serves as the striker has been combined with a formed metal piece which serves as a base or mounting member, for mounting for example to the door frame of an automobile body, such as described in U.S. Pat. Nos. 6,073,980 and 6,095,576. Other striker designs have eliminated the use of a cylindrical rod or post as the striker bar by forming the striker bar from stamped metal, integral with the striker body or mounting member, as shown in U.S. Pat. Nos. 5,263,752 and 5,927,774. In both the post and stamped striker bar designs, the striker bar must be secured to the base by some means of fastening or attachment, which in the prior art has been accomplished by punch deformation of an end of the bar within a receiving socket, heat staking, threaded engagement, brazing or welds. These points of attachment are of course critical to the strength of the striker and the resultant latch holding integrity, and so are critical and must be carefully manufactured. Post type striker bars can be in the form of a bolt with a head which fits within a countersink in the base for good attachment strength, as shown for example in U.S. Pat. No. 6,106,037. Striker bars of stamped or formed metal are more commonly attached at one or more points by welds to the striker body, as in U.S. Pat. Nos. 5,501,495 and 5,927,774. Welded attachment of striker bars requires welds of very high strength and quality control, which increases production cost.

SUMMARY OF THE INVENTION

The present invention is of several latch striker designs which have a striker bar integrally formed with or mechanically attached to a formed base or mounting member. In several of the embodiments, the striker bar extends from the base material, and a locking arm extends from the striker bar to another point on the base where it is mechanically attached to the base. In another embodiment, the locking arm extends from the material of the base and the striker bar is formed at an end of the locking arm. An end of the striker bar is mechanically attached to the base. Dovetail locks and through-pin attachment of the striker bar and locking arm to the base are disclosed and claimed.

In accordance with one broad aspect of the invention, there has been invented single piece latch striker with a base; a striker bar which extends from an edge of the base; a locking arm connected to the striker bar, an attachment end of the locking arm mechanically attached to the base.

In accordance with another aspect of the invention, there is provided single piece latch striker having a base, striker bar, and locking arm all formed from a single piece of material, the base having a surface for attachment to a structure, the striker bar extending from the base and connected at a bend to the locking arm, the locking arm extending generally over the base and having an attachment end attached to the base at a location spaced from the striker bar.

These and other inventive attributes of the invention are described herein in particular detail with reference to the accompanying Figures.

DETAILED DESCRIPTION OF PREFERRED AND ALTERNATE EMBODIMENTS

Figure 1:
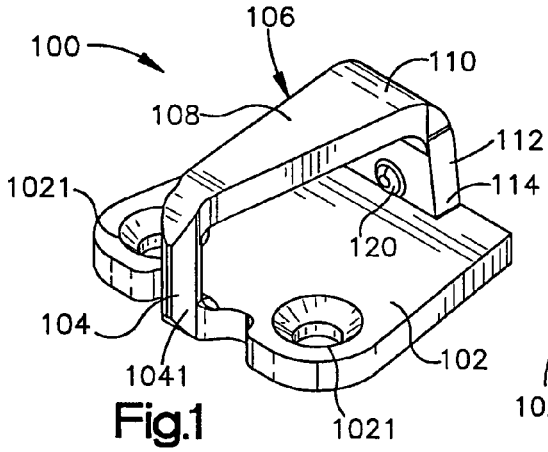
FIGS. 1 and 2 are perspective views of a single piece mechanically locked striker of the present invention.

Referring to FIG. 1, there is shown a striker 100 which has a base 102 (also referred to as a "mounting base" or "mount"), a striker bar 104 which is configured for engagement with the catch or latch pawl of a latch mechanism, and a locking arm 106 which extends from the striker bar 104 to another part of the base 102. The locking arm 106 includes a bridge 108 which extends from the striker bar 104 generally over the base 102, an elbow 110 at an end of the bridge 108 generally opposite the striker bar 104, and a trunk 112 which terminates with an attachment end 114 which engages with the base 102. The base 102 may include one or more mounting holes 1021 for fasteners or studs for attachment of the base to a supporting structure such as a door frame, such as an automobile door frame.

The enhanced structural strength of this particular design derives from the direct formation and extension of the striker bar 104 from the base 102, from the same material of the base 102, without any weld or fastener connection at the junction of the striker bar and base. The striker bar 104 is further strengthened in the orientation projecting away from the base by the integral extension of the locking arm 106 from an end opposite the base 102, with the bridge 108 extending to an opposite edge of the base 102. The locking arm 106 continues over the base 102 through elbow 110 into the trunk 112 which extends back to the base 102, terminating at attachment end 114 which is mechanically attached to the base as further described.

Figure 2:
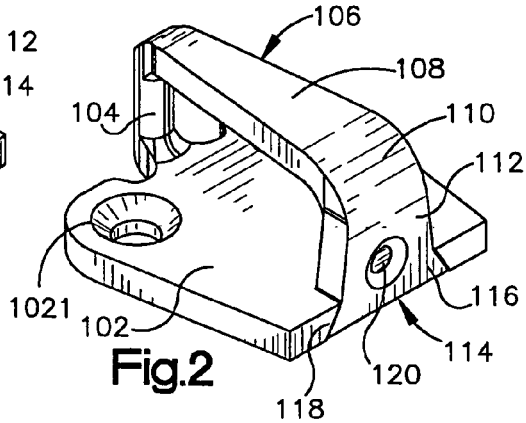
Figure 3:
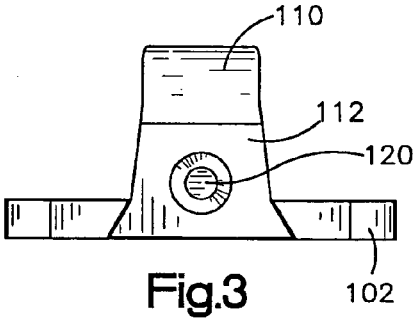
FIGS. 3 and 4 are elevations of the single piece mechanically locked striker of FIGS. 1 and 2.
Figure 4:
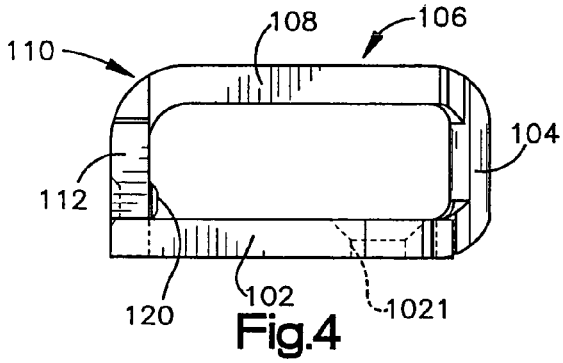

A dovetail 116 formed at an edge of attachment end 114 fits in double beveled recess 118 in base 102 which is formed to mechanically attach the attachment end 114 of the locking arm 106 and base 102, as shown in FIGS. 2 and 3. This mechanical attachment is further strengthened by a punch offset 120 formed in the attachment end 114 to project inward over the surface of base 102, thereby drawing the mating surfaces of the dovetail 116 into tight contact with the beveled surfaces 118 of base 102. This mechanical attachment of the locking arm component of the striker to the base resists forces applied in a direction away from the base 102 toward the bridge 108, and forces applied in a direction normal to the axis of the striker bar 104, away from the base 102 and trunk 112, which is the latch opening direction. Advantageously, this mechanical attachment does not rely on any welds or separate fastening devices. As shown in FIG. 3, the triangular shape of the dovetail 116 increases lateral strength of the connection. The surface area of the attachment end 114 which faces the striker bar 104 serves as a latch backplate or backstop relative to the periphery of the fishmouth of a latch assembly engaged with the striker, which prevents over-engagement of the striker by the latch assembly under collision-scale forces.

Figure 5:
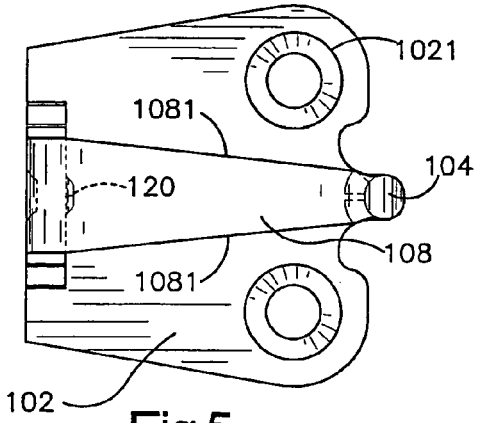
FIG. 5 is a plan view of the single piece mechanically locked striker of FIGS. 1–4.
Figure 6:
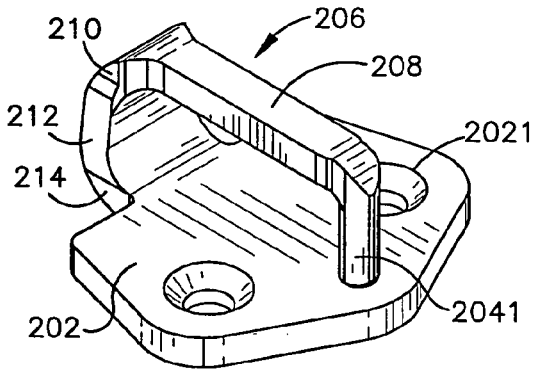
FIGS. 6 and 7 are perspective views of an alternate embodiment of a single piece mechanically locked striker of the present invention.
Figure 7:
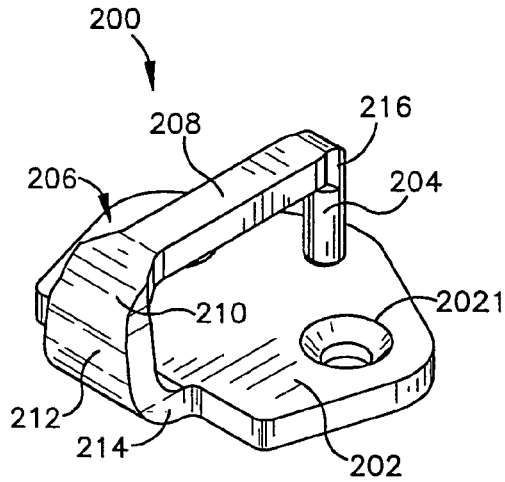
Figure 8:
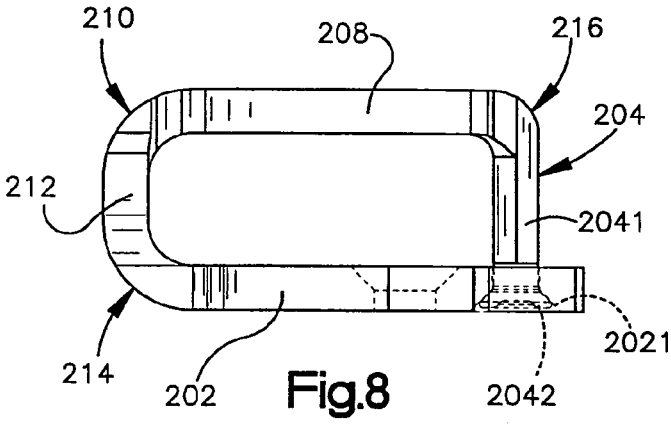
FIG. 8 is an elevation of the single piece mechanically locked striker of FIGS. 6 and 7.
Figure 9:
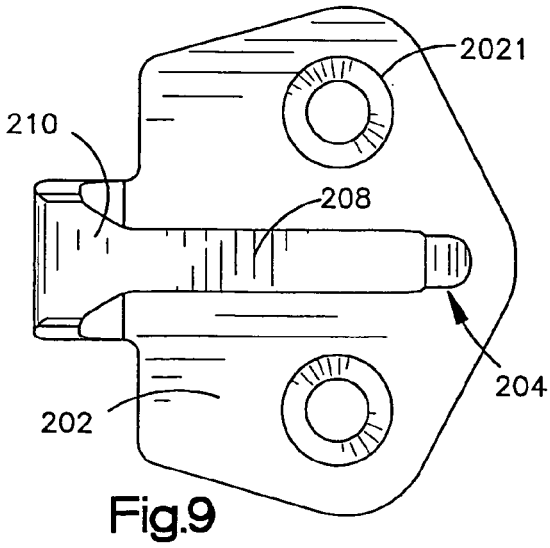
FIG. 9 is a plan view of the single piece mechanically locked striker of FIGS. 6–8.
Figure 10:
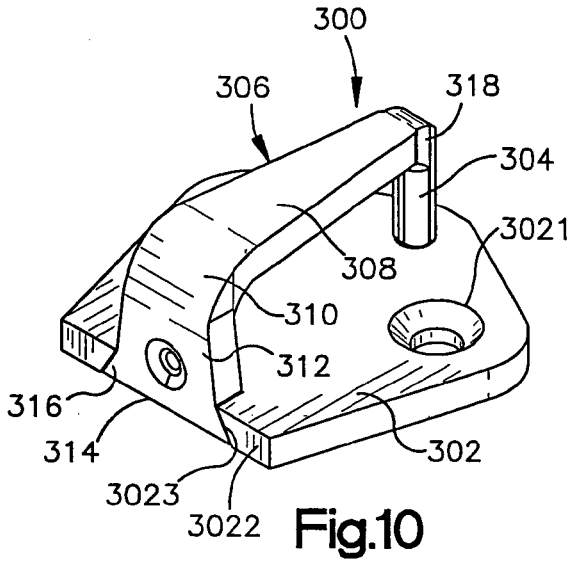
FIGS. 10–11 are perspective views of a two-piece mechanically locked striker of the present invention.
Figure 11:
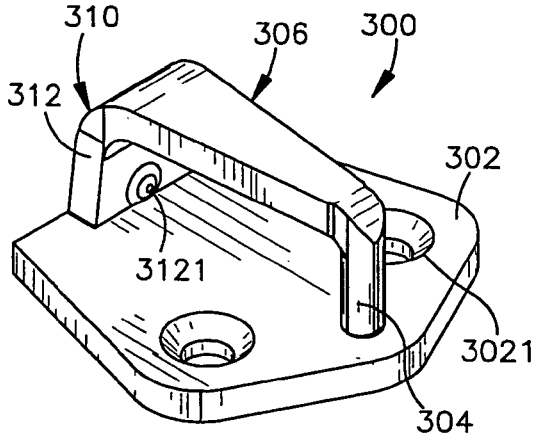

FIG. 5 illustrates the relative width of the trunk 112 and attachment end 114 to the striker bar 104 which further strengthens the mechanical attachment and resistance to any displacement or deformation of the striker bar which could lead to uncontrolled disengagement of the latch. FIG. 5 also illustrates the tapered edges 1081 of the bridge 108, which further strengthen lateral rigidity, and which may be designed to closely interface with the periphery of the fishmouth of a latch assembly. The striker bar profile 1041 may be coined for smooth operative engagement with a latch mechanism.

The inherent strength of this striker design is further derived from its one-piece formation, and that the bends or folds between the components of the base, striker bar and bridge are aligned with the striker bar attachment end where the resistive forces are concentrated. In the unfolded configuration, blanks for the strikers can be nested to reduce scrap.

FIGS. 6–10 illustrate another embodiment of a one-piece latch striker, indicated generally at 200, which has a locking arm 206 and bridge 208 which are integrally formed with a base 202. A striker bar 204 extends from a distal end of bridge 208, and a terminal end of the striker bar 204 is mechanically engaged with the base 202. The locking arm 206 has a trunk 212 which is attached through a first bend 214 to the base 202. The bridge 208 of the locking arm 206 is connected to the trunk 212 through a second bend or elbow 210. An opposite end of the bridge 208 terminates in a striker bar 204, which may be angularly oriented with respect to the bridge through bend 216. The locking arm 206 and striker bar 204 are thus integrally formed with the base 202 as a single piece structure. A terminal end 2042 of the striker bar fits through an opening 2021 in base 202. Terminal end 2042 is die punched or heat staked to form a head within the tapers or opening 2021 to securely anchor the striker bar 204 relative to base 202. Striking surfaces 2041 of the striker bar 204 may be coined to provide a rounded contact for smooth engagement and disengagement operation with a latch mechanism. In this embodiment also the bridge 208 can be tapered from bend 210 toward the striker bar 204 to match a tapered throat of the housing of latch mechanism for precise interface.

FIGS. 10–17 illustrate two-piece embodiments of mechanically locked latch strikers of the invention, indicated generally at 300, wherein the base is formed as a separate piece from the locking arm/striker bar, which is mechanically attached to the base as described. As shown in FIGS. 10–13, a base 302 is formed as a generally planar piece having several sides and through-holes 3021 for installation of fasteners to secure the base to a supporting structure. A cut-out or recess 3023 is formed in an edge 3022 of base 302 to accept a dovetail 316 on attachment end 314 of a locking arm 306. The cut-out or recess 3023 is preferably in the form of a tapered key cut, with the taper angles converging toward the surface of the base 302 from which the locking arm extends. This provides a strong mechanical attachment of the locking arm 306 to the base 302 which resists the primary loads normal to base 302 and toward the striker bar 304, as well as other loads and forces applied in operation with a latch mechanism. A punch 3121 can be made in the trunk 312 just above the dovetail 316 and the surface of base 302 to positively lock the dovetail 316 in the tapered opening 3023.

Figure 12:
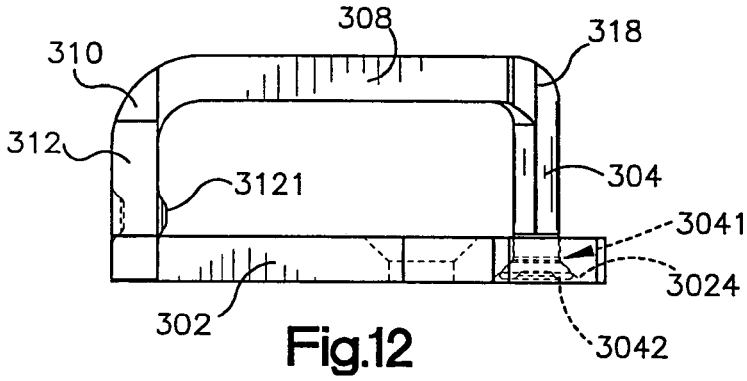
FIG. 12 is an elevation of the two-piece mechanically locked striker of FIGS. 10–11.
Figure 13:
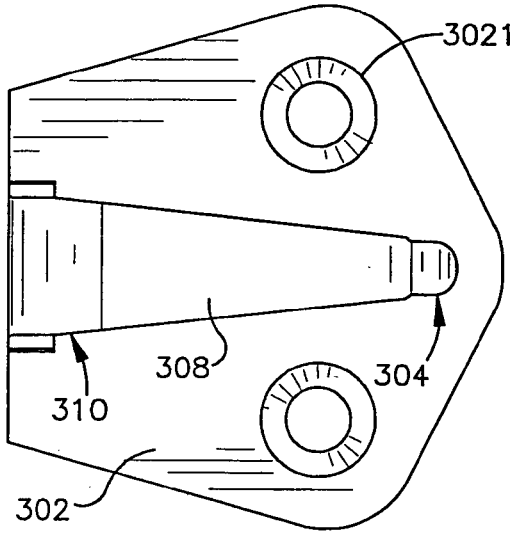
FIG. 13 is a plan view of the two-piece mechanically locked striker of FIGS. 10–12.
Figure 14:
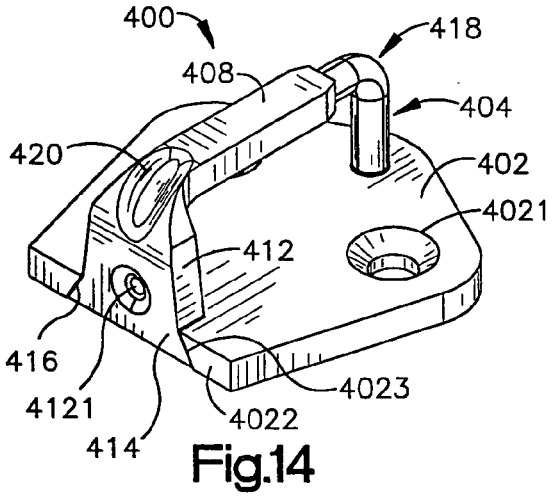
FIGS. 14 and 15 are perspective views of an alternate embodiment of a two-piece mechanically locked striker of the present invention.
Figure 15:
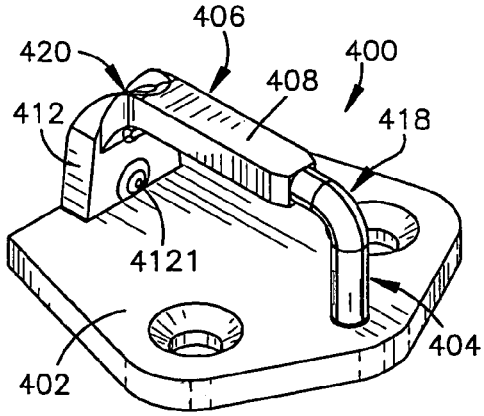
Figure 16:
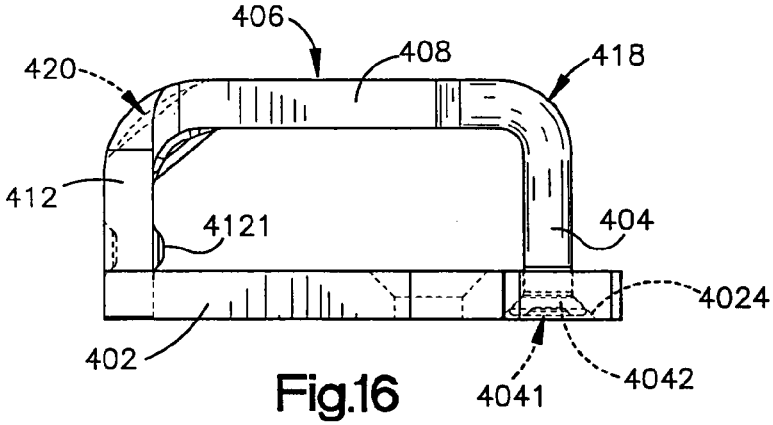
FIG. 16 is an elevation of the two-piece mechanically locked striker of FIGS. 14–15.
Figure 17:
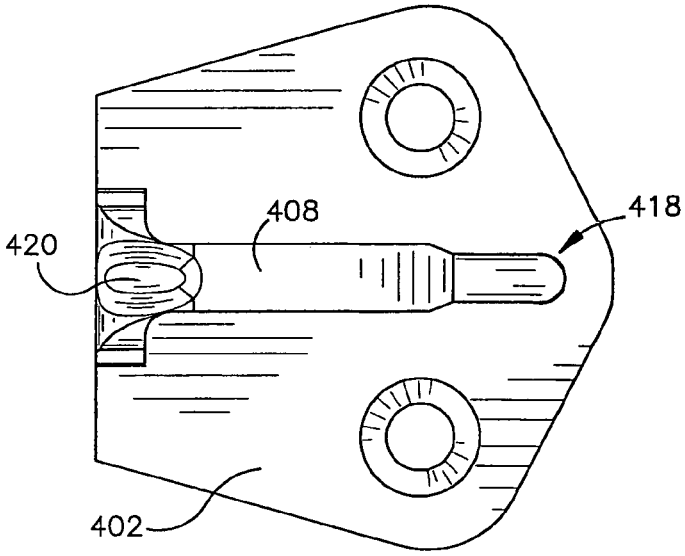
FIG. 17 is a plan view of the two-piece mechanically locked striker of FIGS. 14–16.

The locking arm 306 continues above dovetail 316 with a trunk 312 into bend 310 to join bridge 308. The bridge 308 may be tapered toward the striker bar 304 as shown in FIG. 13, or elliptical with the side edges of the bridge flaring out between the striker bar 304 and trunk 312 to fit within a corresponding fishmouth of a latch housing to provide anti-chucking and transverse support to the door on which the latch is mounted. A second bend 318 is formed at an opposite end of bridge 308, and striker bar 304 formed thereafter to extend back to base 302. As shown in FIG. 12, a distal end 3041 of the striker bar 304 extends through a tapered opening 3024 in base 302 and is heat-staked or punched to form a head 3042 which serves to mechanically lock the striker bar 304 to base 302.

Although shown in planar form, the base 302 may be contoured and dimensioned to fit with any type or shape of supporting structure, so long as it includes the mechanical attachment points for the locking arm and striker bar as described.

FIGS. 14–17 illustrate an alternate embodiment of a two-piece latch striker 400. In the latch striker 400, the locking arm/striker bar 406/404 are formed as a separate piece which is mechanically attached to base 402 in a manner similar to that of latch striker 300. A strengthening gusset 420 is formed between the locking arm trunk 412 and bridge 408, making the locking arm/bridge/striker bar structure more rigid and resistant to deformation or failure under normal and excessive loads. The gusset also provides an anti-chucking feature by providing a wedge or arc which sits in the fishmouth of a latch assembly to prevent the striker and latch from chattering from vibration while engaged. The gusset also makes the bridge more rigid, as may be required in designs wherein the striker bar length is extended.

The striker bar 404 is curved at 418 to join an end of bridge 408. The distal end 4041 of the striker bar 404 is mechanically attached to the base by a through-fit with a tapered opening 4024, and punched to form a head 4042 within opening 4024. This design, wherein the striker bar 404 is not necessarily straight, is suitable for use with latch mechanisms that do not require a striker with substantial linear extent, or for latches which operate and engage with a curved striker bar, or a striker bar which has straight and curved segments. Other configurations of the locking arm and/or striker bar can be used with planar or non-planar bases, making the two-piece embodiments of the mechanically locked latch strikers particularly adaptable to a wide range of applications, without compromising the excellent strength of the mechanical connections.

The invention claimed is:

1. A single piece latch striker comprising:

a base;

a striker bar which extends from an edge of the base;

a locking arm extending from the striker bar, an attachment end of the locking arm mechanically attached to the base wherein the attachment end of the locking arm includes a dovetail which fits with a cut-out in the base.

2. The latch striker of claim 1 wherein the striker bar extends from an edge of the base and away from a plane of the base.

3. The latch striker of claim 1 wherein the locking arm extends from and end of the striker bar spaced from the base.

4. The latch striker of claim 1 wherein the locking arm extends over the base.

5. The latch striker of claim 1 wherein the locking arm includes a bridge which is spaced from the base, and a trunk which extends from the bridge to the base.

6. The latch striker of claim 5 wherein the locking arm includes a bend between the bridge and the trunk.

7. The latch striker of claim 5 wherein the bridge is tapered.

8. The latch striker of claim 1 wherein a segment of the striker bar is located outside of an area of the base.

9. The latch striker of claim 1 wherein the base is non-planar.

10. The latch striker of claim 5 further including an offset in the locking arm proximate to the base.

11. A single piece latch striker having a base, striker bar, and locking arm all formed from a single piece of material, the base having a surface for attachment to a structure, the striker bar extending from the base and connected at a bend to the locking arm, the locking arm extending over the base and having an attachment end mechanically attached to the base at a location spaced from the striker bar.

12. A single piece latch striker comprising a base, locking arm, and striker bar all formed of a single piece of material, wherein the locking arm extends from the base, the locking arm having a bridge which is folded to extend over at least a portion of the base, and a striker bar which extends from the bridge to the base and is mechanically attached to the base.

13. The latch striker of claim 12 wherein the striker bar is mechanically attached to the base.

14. The latch striker of claim 12 wherein the bridge has a substantially uniform width.

15. The latch striker of claim 12 comprising two bends in the locking arm between the bridge and base, and one bend between the bridge and the striker bar.

16. The latch striker of claim 12 formed by progressive dies which form two bends in the locking arm between the bridge and the base, and one bend between the bridge and the striker bar.

* * * * *